US005460126A

United States Patent [19]

Szelewski

[11] Patent Number: 5,460,126

[45] Date of Patent: Oct. 24, 1995

[54] RADIO TRANSPORT HARNESS

[76] Inventor: Peter T. Szelewski, 215 Stolp Ave., Syracuse, N.Y. 13207

[21] Appl. No.: 231,653

[22] Filed: Apr. 25, 1994

[51] Int. Cl.[6] ..... A01K 29/00

[52] U.S. Cl. ..... 119/859

[58] Field of Search ..... 119/859, 729, 119/770, 769, 714; 182/3, 4, 5

[56] References Cited

U.S. PATENT DOCUMENTS

| | | | |
|---|---|---|---|
| 1,738,581 | 12/1929 | Hodgson | 119/770 |
| 3,088,438 | 5/1963 | Oliphant | 119/770 |
| 4,666,017 | 5/1987 | Zimmerman | 119/770 |

*Primary Examiner*—Gene Mancene
*Assistant Examiner*—Thomas Price

[57] ABSTRACT

A radio transport harness having a plurality of torso straps and the torso straps including spaced first and second shoulder straps to secure the first and second torso straps together, with a rod assembly extending from the first strap to the second strap and extending further beyond the second strap terminating in a support base, wherein the rod assembly includes a plurality of pivot joints interconnecting portions of the rod assembly permitting articulation of the rod assembly, wherein the support base includes a cushion layer top wall and a plurality of strap members to secure a radio assembly onto the cushion layer top wall.

4 Claims, 4 Drawing Sheets

RADIO TRANSPORT HARNESS

TECHNICAL FIELD

The field of invention relates to the transport of various components, and more particularly relates to a means of securing and transporting a radio member.

BACKGROUND OF THE INVENTION

The advent of large radios contemporarily referred to as "boom-boxes" is a part of society, wherein the instant invention addresses the transport of such radios for prolonged periods of time without undue physical burdening of an individual. While other harness structure has been available in the prior art to transport various camping gear and the like, such as indicated in U.S. Pat. No. 4,809,896 and 4,327,852, the harness structure has been of a generally generic nature. U.S. Pat. No. 5,016,794 sets forth a backpack structure arranged for the combination of a skate board assembly with associated structure therefore. Heretofore, however, the prior art has not addressed the transport and specific structure for the securement of radio members and in this respect, the invention overcomes such deficiencies in the prior art.

SUMMARY OF THE INVENTION

The present invention relates to a backpack and harness structure, wherein first and second torso straps are secured together by first and second shoulder straps, with a rod assembly extending between the shoulder straps and projecting from the first and second straps to support a support base that in turn secures a radio assembly thereon.

Objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms. therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
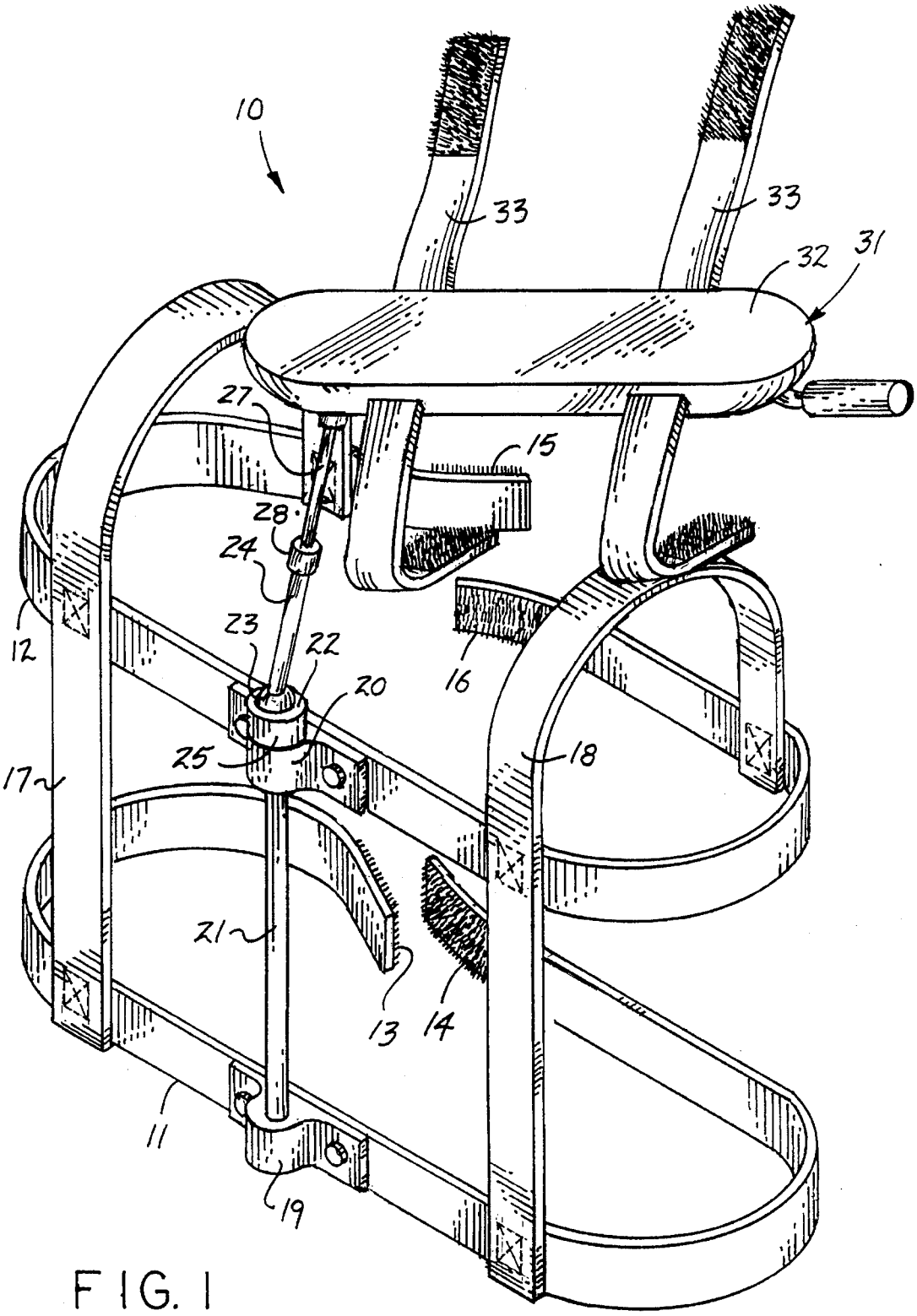
FIG. 1 is a prospective view of the invention.
Figure 3:
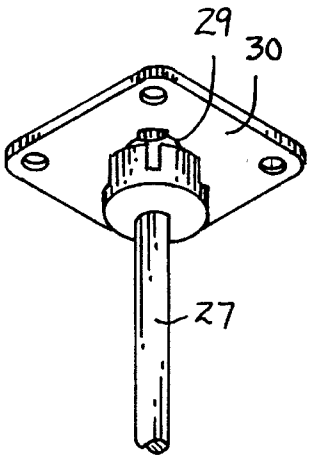
FIG. 3 is a prospective view, taken along the section lines 3—3 of FIG. 2.
Figure 2:
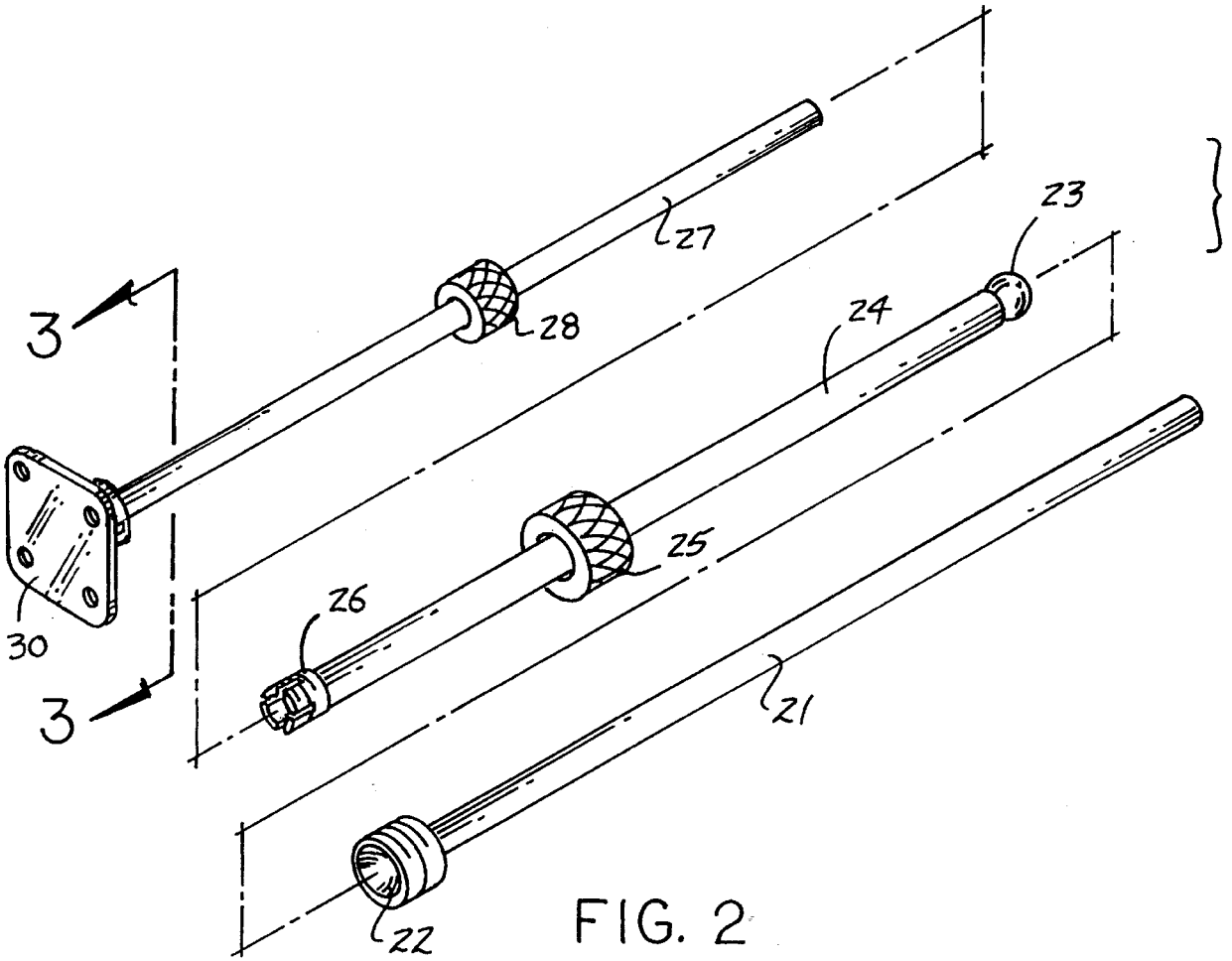
FIG. 2 is an exploded prospective illustration of the support rod structure employed by the invention.
Figure 4:
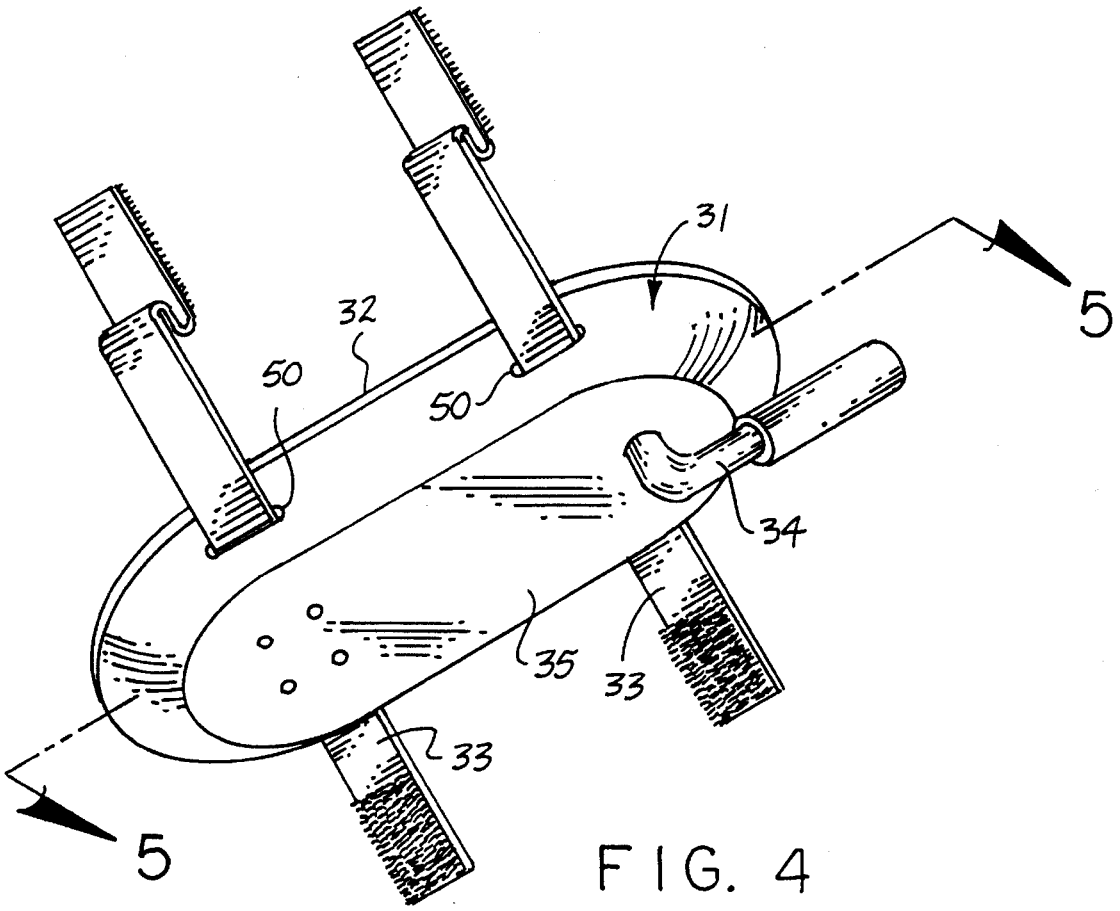
FIG. 4 is a bottom prospective view of the support base structure of the invention.
Figure 5:
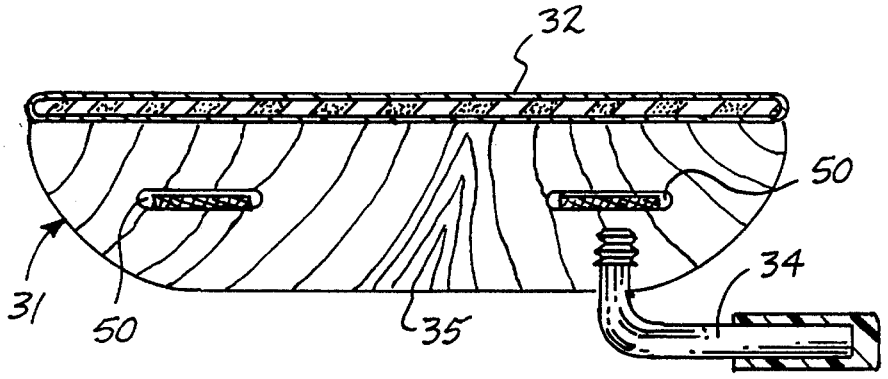
FIG. 5 is a sectional view of the section lines 5—5 of FIG. 4.
Figure 6:
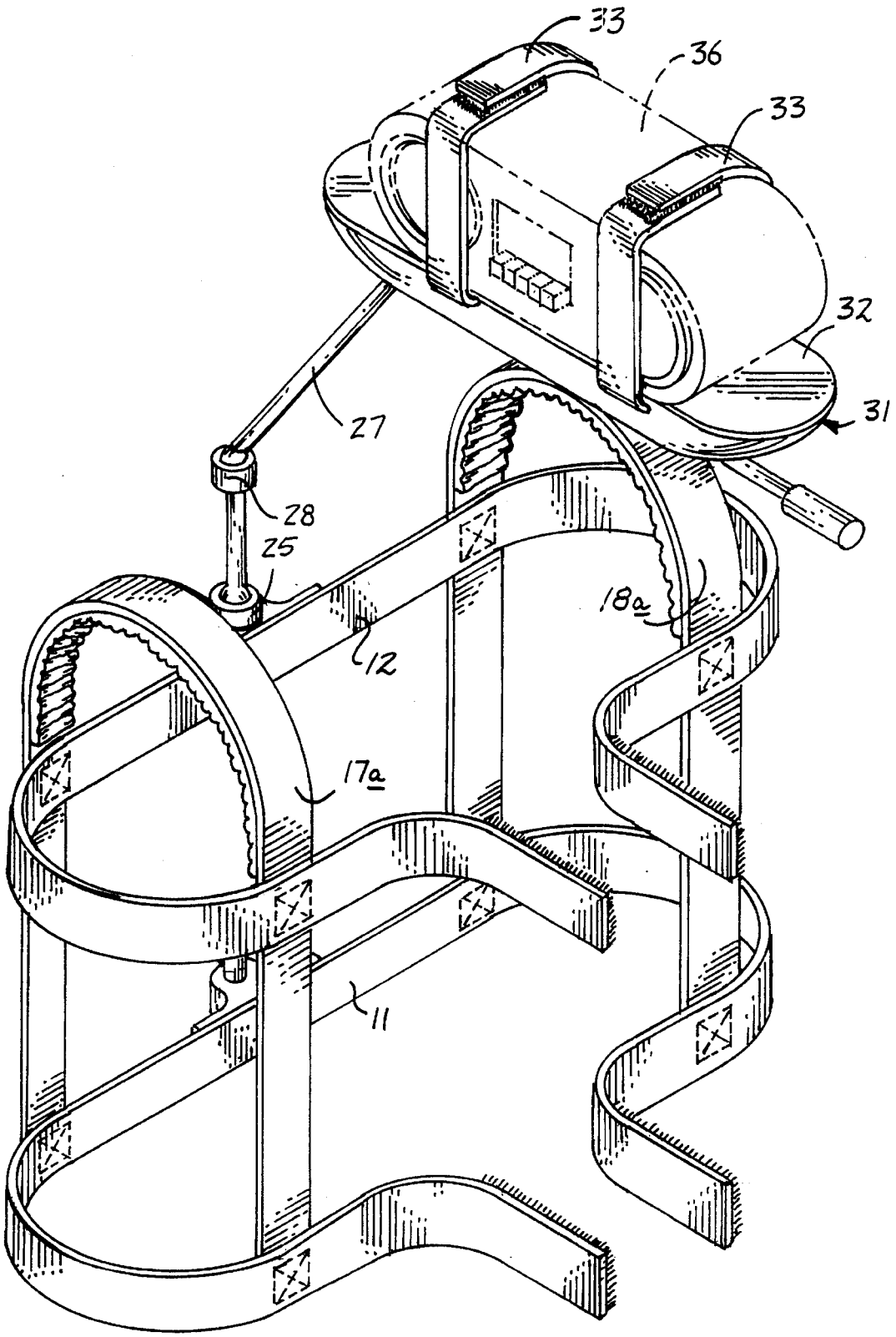
FIG. 6 is a prospective view of the invention employing modified shoulder strap structure.

The invention includes spaced first and second flexible straps 11 and 12 respectively arranged in a coextensive relationship arranged for securement about an individual's torso, such that the respective first and second straps are provided with respective first and second strap fastener portions, typically of hook and loop fastener inter-relationship, as indicated by the first strap hook and loop fastener portions 13 and 14 and the second strap first and second hook and loop fastener portions 15 and 16 to permit adjustable securement about an individual's torso region. First and second shoulder straps 17 and 18 of a generally J-shaped configuration extend from the first strap fixedly to the second strap and are looped for subsequent additional securement to the second strap structure in adjacency to the second strap's first and second fastener portions 15 and 16. A mounting boss 19 is secured to the first strap between the first and second shoulder straps, such that a first rod 21 is secured thereto and extends parallel between the first and second shoulder straps 17 and 18 to a retainer strap 20 secured to the second strap 12. Reference to FIG. 2 indicates the association of the support rod structure, such that a first rod 21 extends from the mounting boss 19 and terminates in an externally threaded spherical socket portion 22 that receives a pivot sphere 23 of a second rod 24 of tubular construction to telescopingly receive a third rod 27. A spherical connector sleeve 25 is threadedly secured to the externally threaded spherical socket portion 22 to capture the pivot sphere 23 within the externally threaded spherical socket portion 22. Spaced from the pivot sphere 23 of the second rod 24 is an externally threaded split collet 26 threadedly receiving a collet connector sleeve 28 slidably mounted onto the third rod 27 to thereby secure the third rod 27 in a desired telescoping relationship within the second rod 24. The third rod 27 terminates in a socket to pivotally receive a pivot ball 29 that in turn is affixed to a mounting plate 30. The mounting plate 30 is secured by the use of conventional fasteners (not shown) onto the support base 31, and more specifically the support base bottom wall 35. The support base is provided with a support base top wall having a cushion layer 32 coextensive therewith to receive the radio assembly thereon, in a manner as indicated by the radio 36 indicated in phantom in FIG. 6. Support base straps 33 extend slidably through respective openings 50 the side walls of the support base in a parallel relationship to extend over the cushion layer 32, such as indicated in FIG. 6, to secure the radio 36 onto the cushion layer 32. The cushion layer provides for shock-absorbency during transport of the radio 36. Further, a handle rod 34 of a generally L-shaped configuration extends fixedly from the support base bottom wall 35 for ease of manual grasping and manipulation of the support base 31 onto a desired orientation relative to an individual mounting the harness structure 10.

The FIG. 6 further provides for, if desired, modified first and second shoulder straps 17*a* and 18*a* of a generally U-shaped configuration to extend from the first and second straps and thereafter connect once again to the second strap 12 and once again to the first strap 11 for greater security in structural association of the various components of the invention.

It is to be understood that while certain forms of the present invention have been illustrated and described herein, it is not to be limited to the specific forms or arrangement of parts described and shown.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed and desired to be protected by Letters Patent of the United States is as follows:

1. A radio transport harness comprising, a discontinuous first strap spaced from a discontinuous second strap, wherein the first strap includes first fastener means for securement of the first strap together, and the second strap having second strap means for securement of the second strap together, and a first shoulder strap secured to the first strap at a first position and secured to the second strap at a plurality of positions, and a second shoulder strap spaced from the first shoulder strap, with the second shoulder strap secured to the first strap at a single position, and the second shoulder strap secured to the second strap at a plurality of positions, and a rod assembly secured to at least said second strap and extending from the second shoulder strap, with the rod assembly terminating in a support base, with the support base pivotally mounted to the rod assembly, and the support base having a support base top wall and a support base bottom wall, and a support base side wall, with the rod assembly extending to the support base bottom wall, and at least one strap member directed through the support base side wall for securement about a radio member mounted onto the support base top wall.

2. A radio transport harness as set forth in claim 1 wherein the rod assembly includes a mounting boss fixedly secured to the first strap intermediate the first shoulder strap and the second shoulder strap, with a first rod secured to the mounting boss, and the first rod extending to the second strap between the first shoulder strap and the second shoulder strap, and a retainer strap mounted to the second strap securing the first rod to the second strap, and the first rod terminating in a spherical socket portion, and the rod assembly further including a second rod of tubular construction, with the second rod including a second rod first end having a pivot sphere pivotally secured to the spherical socket portion, and the second rod having a second rod second end and a third rod, the third rod telescopingly received within the second rod second end and the second rod second end further including an externally threaded split collet, and the third rod having a collet connector sleeve securing the third rod to the second rod, and the third rod terminating in a mounting plate spaced from the split collet, and the mounting plate secured to the support base bottom wall.

3. A radio transport harness as set forth in claim 2 wherein the mounting plate further includes a pivot ball fixedly secured to the mounting plate and pivotally mounted to the third rod.

4. A radio transport harness as set forth in claim 3 further including a rigid L-shaped handle extending fixedly from the support base and projecting beyond the support base side wall.

* * * * *